US010514159B2

(12) United States Patent
Loyola Flamarique

(10) Patent No.: US 10,514,159 B2
(45) Date of Patent: Dec. 24, 2019

(54) HEAT SINK FOR LED FIXTURES

(71) Applicant: ITEM 1020, S.L., Arre (navarra) (ES)

(72) Inventor: Maria Angeles Loyola Flamarique, Arre (ES)

(73) Assignee: ITEM 1020, S.L., Arre (Navarra) (ES)

( * ) Notice: Subject to any disclaimer, the term of this patent is extended or adjusted under 35 U.S.C. 154(b) by 0 days.

(21) Appl. No.: 15/771,014

(22) PCT Filed: Aug. 23, 2016

(86) PCT No.: PCT/ES2016/070607

§ 371 (c)(1),
(2) Date: Apr. 25, 2018

(87) PCT Pub. No.: WO2017/072376

PCT Pub. Date: May 4, 2017

(65) Prior Publication Data

US 2018/0306427 A1 Oct. 25, 2018

(30) Foreign Application Priority Data

Oct. 30, 2015 (ES) ..... 201531556

(51) Int. Cl.

| | |
|---|---|
| ***F21V 29/508*** | (2015.01) |
| ***F21V 29/503*** | (2015.01) |
| ***F21V 29/71*** | (2015.01) |
| ***F21V 29/83*** | (2015.01) |
| ***F21V 29/70*** | (2015.01) |
| *F21Y 115/10* | (2016.01) |

(52) U.S. Cl.

CPC ..... *F21V 29/508* (2015.01); *F21V 29/503* (2015.01); *F21V 29/70* (2015.01); *F21V 29/71* (2015.01); *F21V 29/83* (2015.01); *F21Y 2115/10* (2016.08)

(58) Field of Classification Search

CPC ..... F21V 29/508; F21V 29/503; F21V 29/71; F21V 29/83

See application file for complete search history.

(56) References Cited

U.S. PATENT DOCUMENTS

| | | | | |
|---|---|---|---|---|
| 8,738,937 | B2 * | 5/2014 | David | G06F 1/3203 713/300 |
| 2011/0051414 | A1 * | 3/2011 | Bailey | F21V 3/00 362/235 |
| 2011/0068687 | A1 | 3/2011 | Takahasi et al. | |
| 2011/0234076 | A1 * | 9/2011 | Simon | F21V 23/009 313/46 |

(Continued)

FOREIGN PATENT DOCUMENTS

JP 20140096229 A 4/2014

OTHER PUBLICATIONS

International Search Report dated Feb. 8, 2017 for PCT/ES2016/070607 and English translation.

*Primary Examiner* — Anabel Ton

(74) *Attorney, Agent, or Firm* — Lucas & Mercanti, LLP

(57) ABSTRACT

The present invention relates to a heat sink for LED fixtures which comprises a heat-conducting laminar body with two opposite faces (11.1, 11.2) and a perimetral surface (11.3), wherein at least one of the faces (11.1, 11.2) integrates one or more LED PCBs (5), and which allows obtaining a more efficient heat dissipation than a fin heat sink does due to its laminar configuration.

11 Claims, 11 Drawing Sheets

(56) References Cited

U.S. PATENT DOCUMENTS

| | | | | |
|---|---|---|---|---|
| 2012/0014117 | A1 | 1/2012 | Huang et al. | |
| 2012/0075858 | A1 | 3/2012 | Hsieh et al. | |
| 2012/0223632 | A1 | 9/2012 | Hussell et al. | |
| 2012/0300454 | A1* | 11/2012 | Ter-Hovhannisyan ... | F21S 8/03<br>362/235 |
| 2015/0308674 | A1 | 10/2015 | Hsiao et al. | |

* cited by examiner

HEAT SINK FOR LED FIXTURES

CROSS REFERENCE TO RELATED APPLICATION

This Application is a 371 of PCT/ES2016/070607 filed on Aug. 23, 2016, which, in turn, claimed the priority of Spanish Patent Application No. 201531556 filed on Oct. 30, 2015, both applications are incorporated herein by reference.

FIELD OF THE ART

The present invention relates to lighting systems, proposing a heat sink for LED fixtures having improved features with respect to conventional sinks provided with fins that are commonly used for dissipating heat produced in LED fixtures.

STATE OF THE ART

In LED fixtures, light is generated by a light emitting diode printed circuit board, commonly known as LED PCB, which can be both rigid and flexible. The heat produced by the LED PCB is one of the factors that has the most negative effect on fixture performance and service life.

To disperse the heat produced in the fixtures, LED PCBs incorporate a heat sink formed by a metal structure provided with fins. The assembly formed by the heat sink and the LED PCB, as well as the equipment for supplying power to the LED PCB, are arranged inside the fixture.

There are space restrictions inside the fixture, and the volume taken up by heat sink fins prevents being able to correctly position the LED PCB power supply equipment or other equipment the fixture may need.

Furthermore, due to there being little space inside the fixture, the equipment must be positioned very close to the heat sink fins, such that they are more exposed to the heat generated by said fins. The geometry of this fin heat sink concentrates heat dissipation on the only surface provided for that purpose, i.e., the surface of the fins, an airflow limited by the dissipating surface being generated as a result. A problem with the fin heat sink is that the heat given off by each of the corresponding faces thereof is concentrated in the volume of air between the fins, so said fins give off heat to one another.

Furthermore, in situations in which the fin heat sink is exposed to the outside, dirt tends to build up between the fins of the sink, which causes the heat dissipation property to decrease significantly, where the rest of the equipment of the fixture is more prone to being affected by heat.

A heat sink which allows preventing problems associated with conventional fin heat sinks is therefore required.

OBJECT OF THE INVENTION

The invention proposes a heat sink having a laminar configuration for LED fixtures which solves the problems associated with heat sinks provided with fins.

The heat sink for fixtures of the invention comprises a heat-conducting laminar body with two opposite faces, wherein at least one of the faces integrates the LED PCB. A heat sink having a laminar configuration without fins is thereby obtained.

The laminar configuration of the heat sink allows obtaining a considerable increase in heat dissipation efficiency with respect to conventional fixtures provided with fin heat sinks. The heat sink of the invention therefore has improved heat dissipation capacity, which allows being able to reduce the size of fixtures in terms of both their extension and their thickness with respect to conventional fixtures using fin heat sinks.

The surface dimensions and thickness of the sink may vary according to the heat dissipation requirements of the LED PCB to assure the correct operation thereof.

It has been envisaged that the LED PCB can be mechanically or chemically integrated in the heat sink, both forming a single body such that heat transfer between them is improved.

The heat sink of the present invention can be installed inside a hermetic LED fixture consisting of a frame with a housing therein in which one or more LED PCBs covered by a light diffuser are distributed, where each LED PCB can be formed by one or more LED units (in the form of a rigid and flexible printed circuit board). Due to its flat design, the heat sink of the invention can adapt to the internal shapes of any LED fixture.

In addition to being able to be installed inside a hermetic fixture without contact with the outside air, the heat sink of the invention can be installed outside said fixture in contact with room temperature air.

DETAILED DESCRIPTION OF THE INVENTION

Figure 1A:
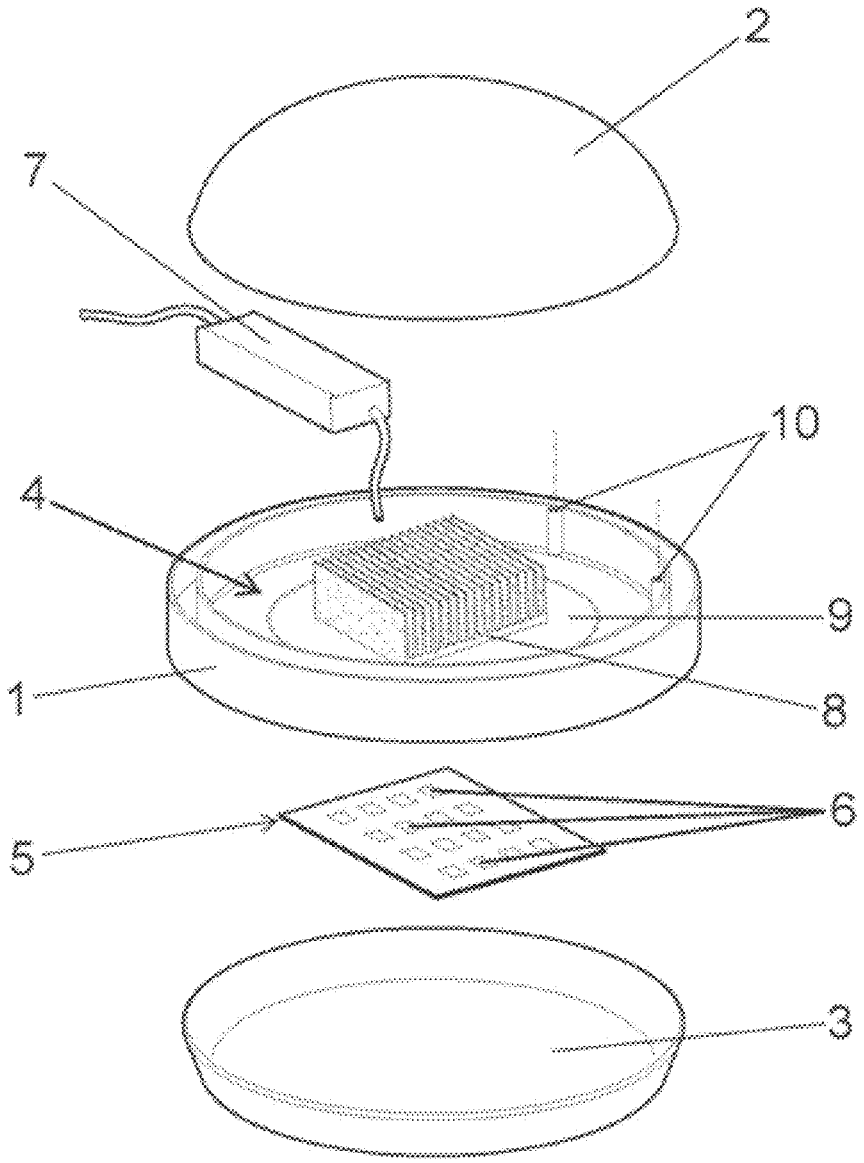
FIG. 1A shows an exploded perspective view of a hermetic LED fixture according to the prior state of the art which is provided with a fin heat sink.

FIG. 1A shows an exploded perspective view of a hermetic LED fixture according to the prior state of the art. The hermetic LED fixture consists of a frame (1) which is closed by means of a cover (2) in its upper part and has a light diffuser (3) in its lower part. The frame (1) has therein a housing (4) in which there is placed a tray (9) where one or more LED PCBs (5) is installed with the fin heat sink (8), LEDs (6), and power supply equipment (7) for the LED PCB (5).

In the part opposite the part where the LEDs (6) are arranged, the LED PCB (5) is associated with a heat sink (8) which has a structure provided with a set of fins. The sink geometry and fin distribution concentrate the dissipated heat on the only surface provided for that purpose, i.e., the surface of the fins. Using a fin heat sink (8) limits the space in the housing (4)

The assembly formed by the LED PCB (5) and the heat sink (8) is attached to a tray (9) which is attached to the frame (1), this tray (9) being what supports the LED PCB (5). To establish the attachment, the frame (1) has holes (10) into which screws are screwed for fixing the tray (9) holding the fin heat sink (8).

Figure 1B:
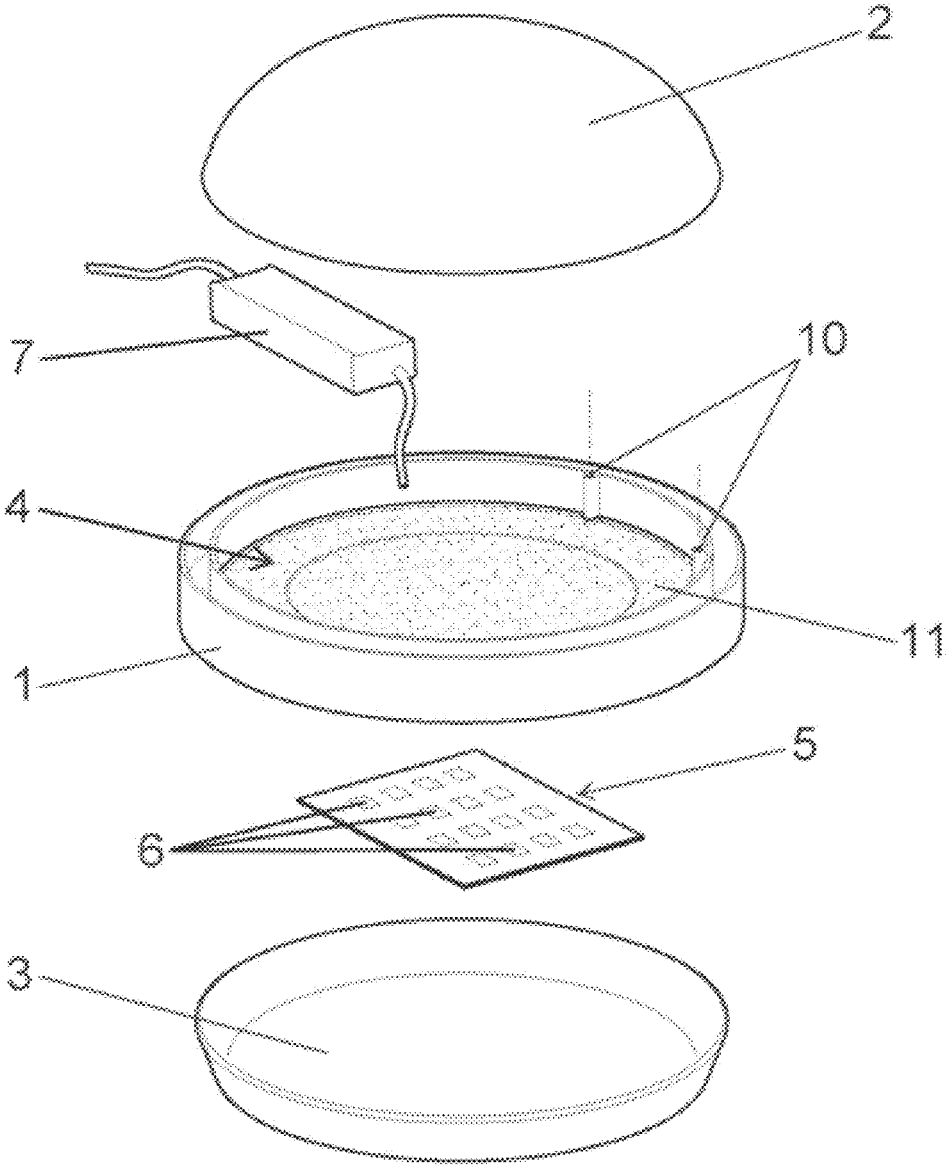
FIG. 1B shows an exploded perspective view of an embodiment of a hermetic LED fixture with a heat sink having a laminar configuration according to the invention.

FIG. 1B shows an embodiment of the invention with a hermetic LED fixture incorporating the dissipation system of the present invention, wherein the fixture is formed by a frame (1) which is closed with a cover (2) in its upper part and has a light diffuser (3) in its lower part, and one or more LED PCBs (5) arranged against the heat sink (11) of the invention which, unlike the fin heat sink (8) of the prior state of the art, does not have a set of fins nor does it require a tray (9) for supporting the LED PCB.

Figure 2A:
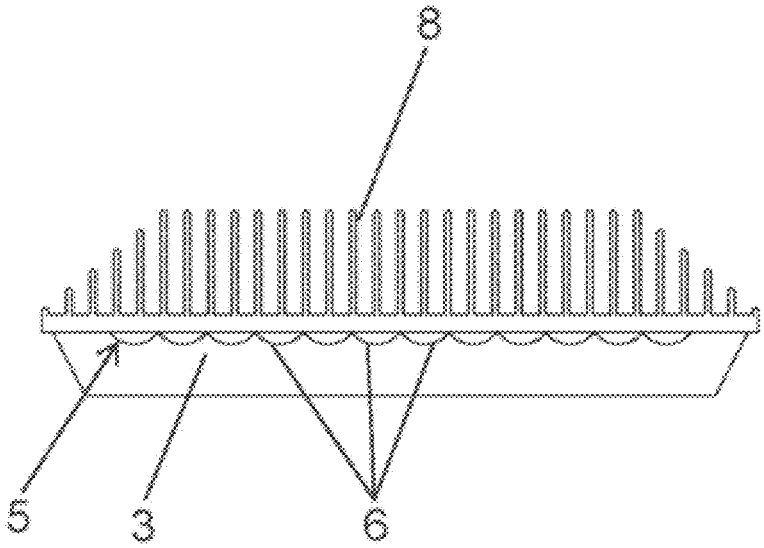
FIG. 2A shows a profile view of a LED fixture provided with a fin heat sink, in contact with the outside air, according to the prior state of the art.

FIG. 2A shows a profile view of a LED fixture according to the prior state of the art, which comprises a LED PCB (5) with LEDs (6) attached to a fin heat sink (8). In this case, like in the hermetic LED fixture, heat is concentrated on the only available surface, i.e., the surface of the fins. Furthermore, dust and dirt tend to build up on the fins, which reduces the performance of the fin heat sink (8), causing an increase in temperature inside the housing (4).

Figure 2B:
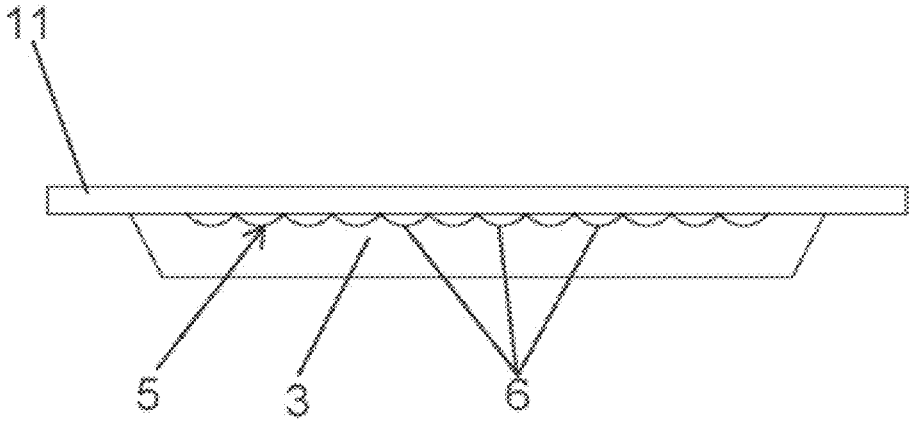
FIG. 2B shows a profile view of another embodiment of a LED fixture with a heat sink having a laminar configuration, in contact with the outside air, according to the invention.

However, FIG. 2B shows another embodiment of the invention, with a LED fixture incorporating the heat sink of the invention (11), which solves the problems associated with the fin heat sink (8).

Figure 3:
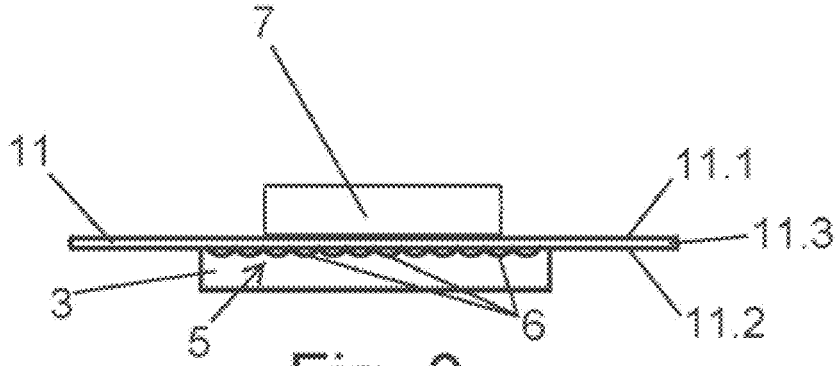
FIG. 3 shows a side view of the heat sink having a laminar configuration of the invention.

As seen in FIG. 3, the heat sink of the invention (11) consists of a conductive laminar body, preferably made of an aluminum material or alloys thereof, with two opposite faces (11.1, 11.2) and a perimetral surface (11.3) that are exposed to the outside, wherein the LED PCB (5) can be integrated on at least one of the faces (11.1, 11.2). The laminar geometry of the heat sink (11) thereby allows the face (11.1) which does not have the LED PCB (5) to be devoid of fins, and to therefore be free for arranging thereon the power supply equipment (7) for the LED PCB (5) or any other type of equipment that the fixture must incorporate.

The space available in the housing (4) of the frame (1), which in the case of hermetic LED fixtures of the prior state of the art was taken up by the fins of the heat sink (8), is thereby optimized with this geometry of the heat sink (11). Furthermore, given that the heat sink (11) has no fins, dirt buildup affecting heat dispersion capacity is prevented.

Figure 1C:
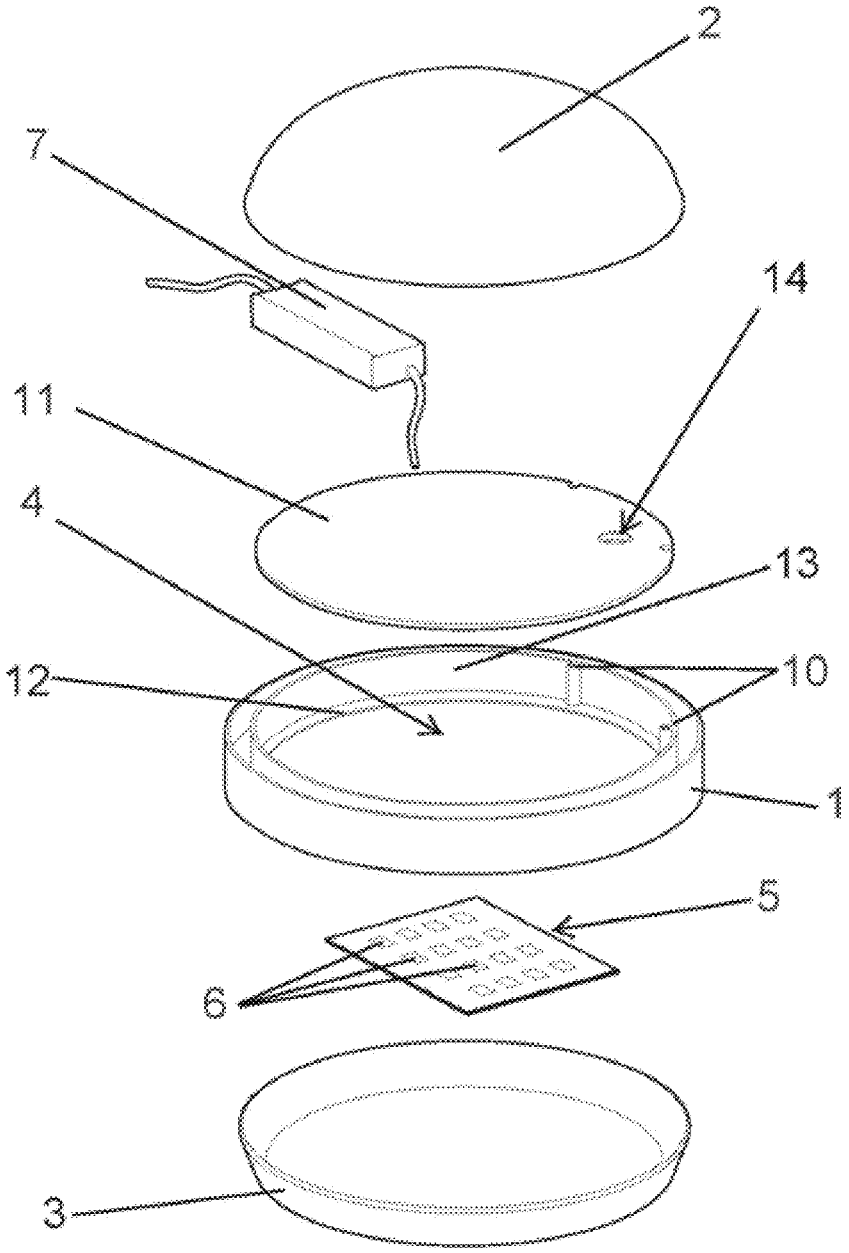
FIG. 1C shows an exploded perspective view of the hermetic LED fixture of the preceding figure with a heat sink having a laminar configuration with a through hole which makes the handling thereof easier.

Furthermore, when the heat sink (11) is arranged in a hermetic LED fixture like the one depicted in FIGS. 1B and 1C, the laminar body of the heat sink (11) has a configuration complementary to the configuration of the housing (4) in which it can be housed, such that the actual laminar body of the heat sink (11) performs the function of anchoring with the frame (1) of the hermetic LED fixture, being directly attached thereto. The frame (1) of the hermetic LED fixture is fixed to the cover (2) using screws that go through holes (10) arranged on the inner perimetral contour of the frame (1) and are screwed into complementary housings of the cover (2).

Figure 1D:
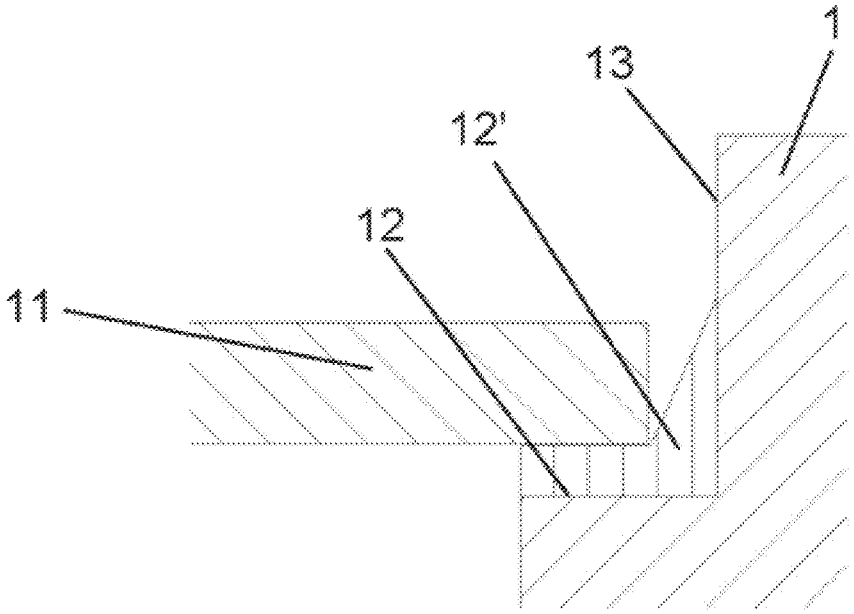
FIG. 1D shows an enlarged view of the detail of the assembly of the heat sink in the housing of the LED fixture of the preceding figure.

As seen in FIGS. 1C and 1D, the frame (1) of the fixture has an inner edge (12) which protrudes into the housing (4) and on which the heat sink (11) is supported through ribs (12'). Said ribs (12') have an L-shaped configuration, wherein one leg of the ribs (12') is supported on the inner edge (12) of the housing (4), and the other leg of the ribs (12') is supported on the inner wall (13) of the frame (1), whereas one of the faces (11.1, 11.2) of the heat sink (11) is supported on the leg of the ribs (12') which are arranged on the inner edge (12).

With this arrangement, the heat sink (11) occupies the entire housing (4) of the frame (1), successfully maximizing the space in the housing (4), and therefore maximizing system heat dissipation efficiency; likewise, the use of the ribs (12') allows the heat sink (11) to be arranged such that it is suspended in the housing (4) and allows the air to flow between the faces (11.1, 11.2) of the heat sink (11) through the space left between the ribs (12'), communicating the air inside the leak-tight compartment forming the fixture and improving heat dissipation.

Figure 1E:
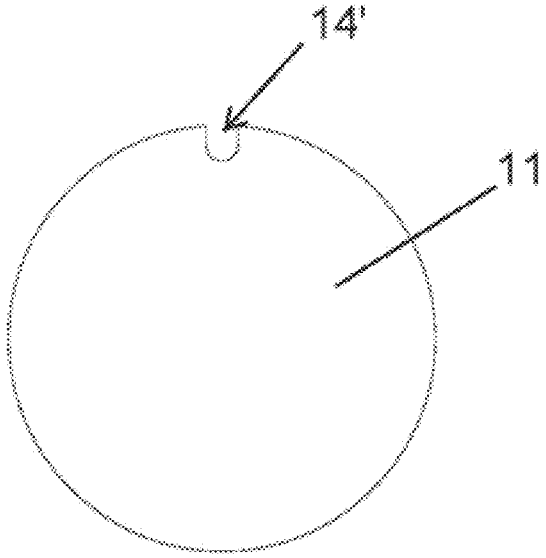
FIG. 1E shows a view of an embodiment of the heat sink having a laminar configuration with a groove on its perimetral surface which makes the handling thereof easier.

Due precisely to the heat sink (11) occupying the entire housing (4) of the frame (1), it has been envisaged for the heat sink (11) to have a through hole (14) which makes the handling thereof easier, as seen in FIG. 1C, and/or a groove (14') arranged on the perimetral surface (11.3) of the heat sink (11), as seen in FIG. 1E, such that by means of inserting a finger or tool into said hole (14) and/or groove (14'), it is easier to remove the heat sink (11) from the housing (4) when performing maintenance or repair tasks, or when replacing the LED PCB (5) or LEDs (6).

This being the case, the conductive laminar body of the heat sink (11) of the invention has a rectangular cross-section that can be arranged in the housing (4) of the frame (1) of a fixture, the two faces (11.1, 11.2) of the heat sink (11) being completely flat over their entire surface, and covering the entire housing (4) of the frame (1) of the fixture on which the heat sink (11) is arranged.

Figure 7:
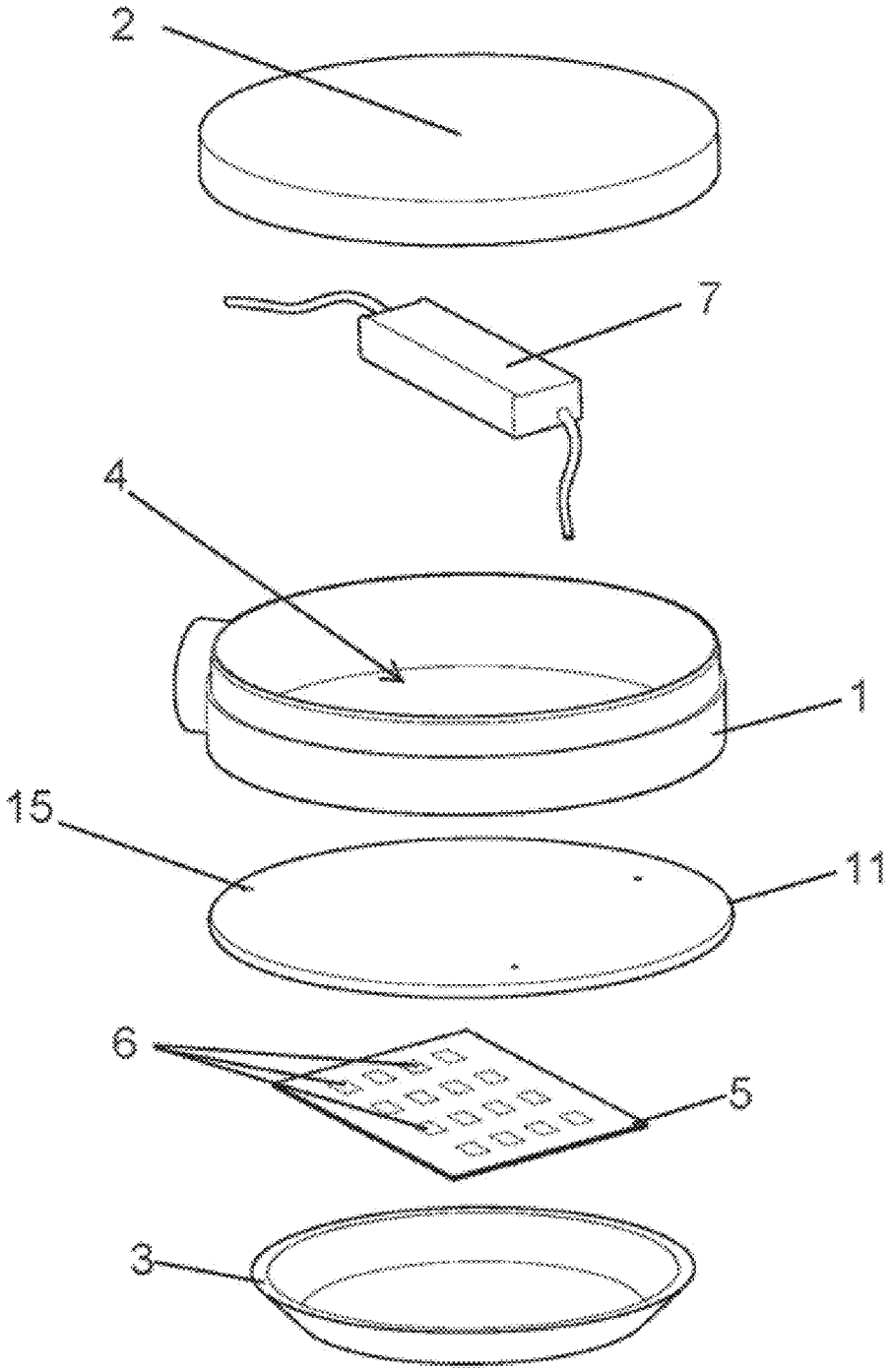
FIG. 7 shows an exploded perspective view of another embodiment of a LED fixture with the heat sink having a laminar configuration of the invention.

FIG. 7 shows another embodiment of a LED fixture with the heat sink (11) having a laminar configuration of the invention, wherein the heat sink (11) is arranged covering the entire housing (4) of the frame (1) of the fixture in the lower part thereof, to that end the frame (1) of the LED fixture is fixed to the laminar body of the heat sink (11) by means of screws that are screwed into complementary housings (15) of the heat sink (11). In this embodiment, like in FIG. 3, the face (11.1, 11.2) of the heat sink (11) on which the LED PCB (5) is arranged is partially covered by the light diffuser (3) of the LED fixture, such that the heat sink (11) protrudes from the fixture in which it is arranged.

As shown in the fixtures of FIGS. 1B, 1C, and 7, the electronic assembly formed by the power supply equipment (7) which is arranged on one face (11.2) of the heat sink (11) is housed in a leak-tight compartment formed by the cover (2), the frame (1), and the heat sink (11), whereas the light assembly formed by the LED PCB (5) and LEDs (6) which is arranged on the other face (11.1) of the heat sink (11) is housed in another leak-tight compartment formed by the heat sink (11) and the light diffuser (3).

The LED PCB (5) has LEDs (6) with a high power greater than 1 W, such as high-power LEDs, OLEDs, or PLEPs, for example. LEDs of this type generate a much greater amount of heat than small conventional LED light bulbs do, so the heat sink (11) of the invention is particularly suitable for dissipating heat generated by LEDs of this type as it has a rectangular cross-section with two faces (11.1, 11.2) having a completely flat surface that cover the entire housing (4) in which they are arranged, taking maximum advantage of the space available in the fixture for heat dissipation.

The arrangement of a layer of thermally insulating material on one of the faces (11.1, 11.2) of the heat sink (11) has been envisaged, such that the electronic assembly formed by the power supply equipment (7) is supported on said layer, being thermally insulated from the heat sink (11).

It has been envisaged that the LED PCB (5) can be directly integrated in the heat sink (11), such that both elements form a single body, thereby improving heat transfer between the LED PCB (5) and the heat sink (11).

Figure 4:
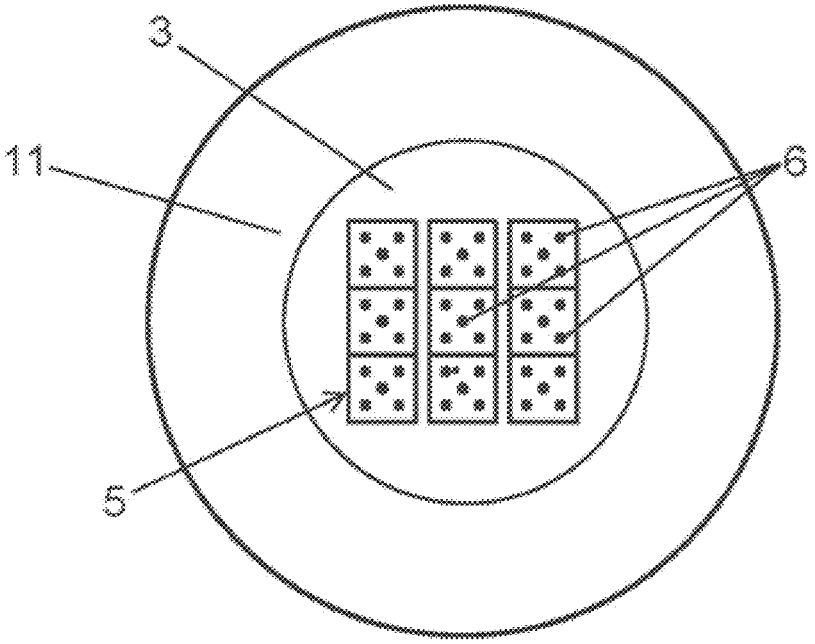
FIG. 4 shows a bottom plan view of the heat sink of the preceding figure.

In FIGS. 1B and 1C, the heat sink (11) is integrated inside a hermetic LED fixture, the heat sink (11) being covered by the closure cover (2), the frame (1), and the light diffuser (3), whereas in FIGS. 2B, 3, and 4, the heat sink (11) can be used in an outdoor LED fixture, such that the light diffuser (3) is attached to the heat sink (11) on the lower face (11.2) thereof, partially covering said lower face (11.2) of the heat sink (11), and the LED or LEDs (6) of the LED PCB or LED PCBs (5) being completely covered. In this embodiment which can use an outdoor LED fixture, there is an area of the heat sink (11) which is not covered by the light diffuser (3) and is therefore exposed to the outside air, thereby improving heat transfer from said heat sink (11).

To prevent oxidation, the possibility of the heat sink (11) being treated, in its entirety or on the surface that is in contact with the outside air, by means of painting, varnishing, or anodizing processes has been envisaged. Treatment by means of an anodizing process generates a coating on one or both faces (11.1, 11.2) of the heat sink (11) which improves thermal conductivity of the heat sink (11) and therefore increases its heat dissipation capacity.

Figure 5:
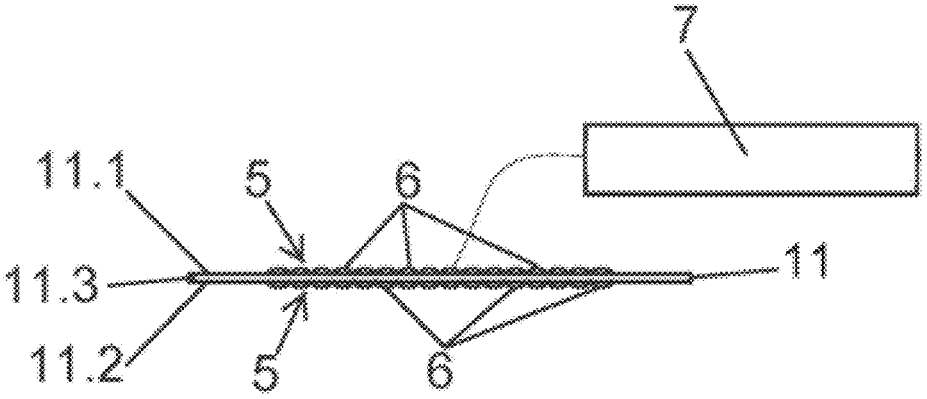
FIG. 5 shows another embodiment of the heat sink having a laminar configuration according to the invention.

FIG. 5 shows another embodiment of the invention in which the laminar body of the heat sink (11) can integrate a LED PCB (5) on each face (11.1, 11.2), where light can be projected from both faces of the LED fixture.

Figure 6:
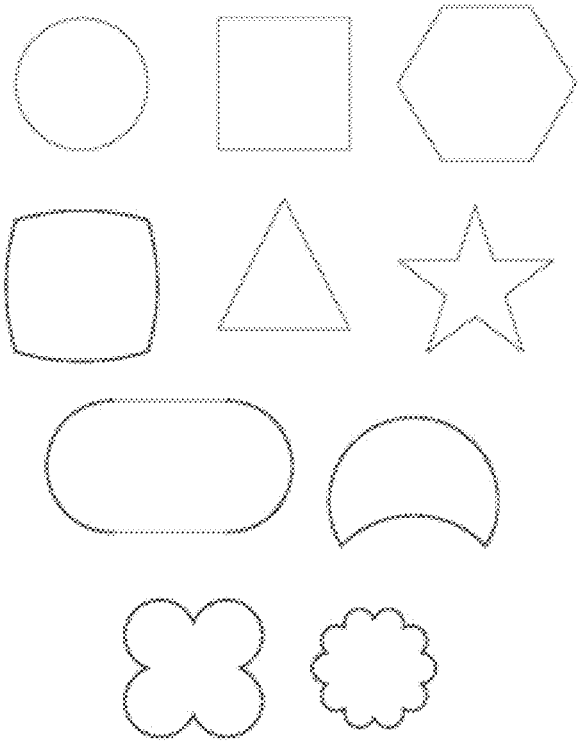
FIG. 6 shows different types of designs that the heat sink of the invention can adopt.

FIG. 6 shows plan views of some examples of the heat sink (11), showing some of the shapes that can be imparted to the heat sink (11) for adapting to possible aesthetic requirements of the market.

The possibility of one or both faces (11.1, 11.2) of the heat sink (11) being able to include text, names, logotypes, stamps, marks, and/or signs, in the form of engraving, machining, die-cutting, pressing, or the like, has been envisaged.

Additionally, it has been envisaged that the light diffuser (3) depicted in the drawings is a tamper-proof light diffuser, such that it allows protecting the LEDs (6) from possible breaking while at the same time performing diffuser functions.

Figure 8A:
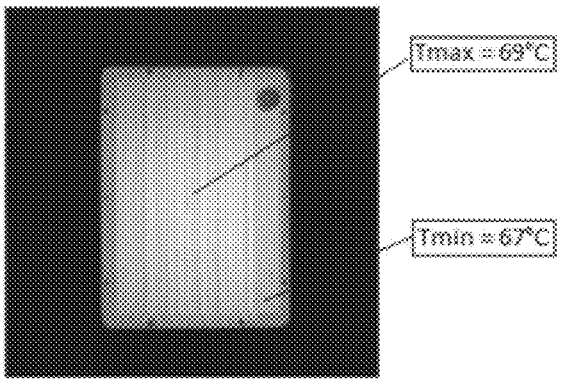
FIG. 8A shows a top view of the thermal image of a fin heat sink in a hermetic LED fixture according to the prior state of the art.
Figure 8B:
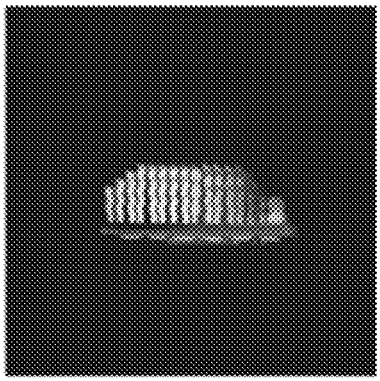
FIG. 8B shows a profile view of the thermal image of a fin heat sink in a hermetic LED fixture according to the prior state of the art.

FIGS. 8A and 8B show thermographic images of the fin heat sink (8) during a test performed in the laboratory inside a hermetic LED fixture that has been switched on and is operating in steady-state conditions under controlled room temperature and humidity conditions. The maximum and minimum temperature reached by the fin heat sink (8) were measured with these test conditions. Once the maximum value is reached, this temperature remains constant throughout the entire time in which the fixture is in operation. The maximum temperature reached in the fin heat sink (8) is 69° C., whereas the minimum temperature is 67° C., at the points indicated in FIG. 8A.

Figure 9A:
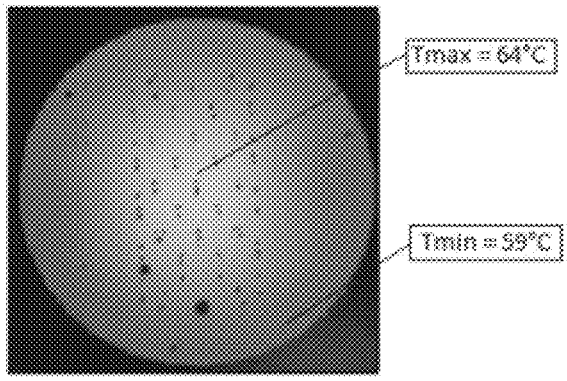
FIG. 9A shows a top view of the thermal image of a heat sink having a laminar configuration in a hermetic LED fixture according to the invention.
Figure 9B:
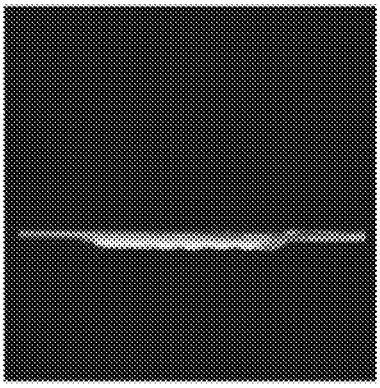
FIG. 9B shows a profile view of the thermal image of a heat sink having a laminar configuration in a hermetic LED fixture according to the invention.

FIGS. 9A and 9B are thermographic images of the heat sink of the invention (11) obtained during a test under the same test conditions described above for the fin heat sink (8). In this case, it is observed that once the point of operating in steady-state conditions has been reached, the maximum temperature in the heat sink of the invention (11) is 64° C. and the minimum temperature is 59° C., at the points indicated in FIG. 9A.

Heat dissipation in the heat sink of the invention (11) is thereby proven to be more efficient than in the fin heat sink (8).

Figure 10:
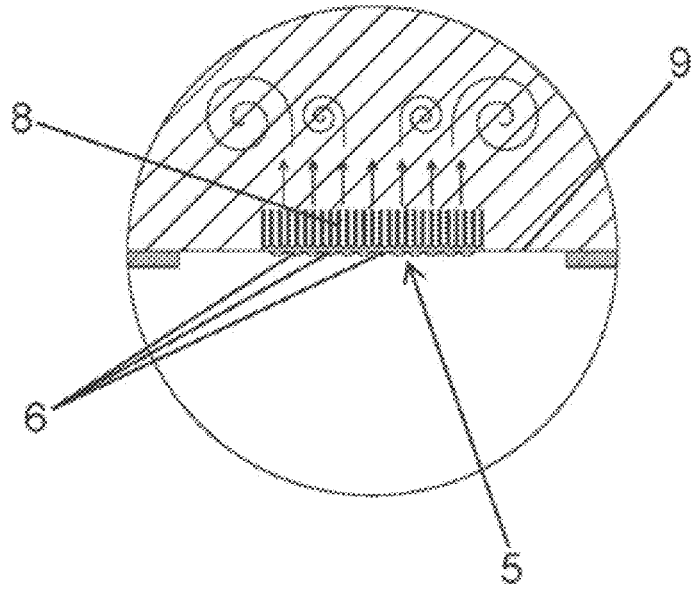
FIG. 10 shows a diagram of the heat dissipation achieved using a fin heat sink according to the prior state of the art.
Figure 11:
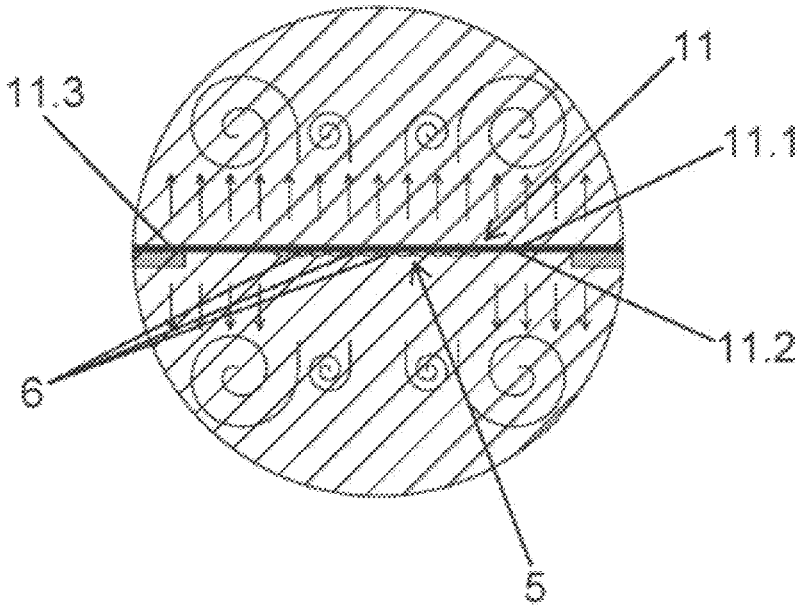
FIG. 11 shows a diagram of the heat dissipation achieved using the heat sink having a laminar configuration of the invention.

The heat sink (11) as shown in FIG. 11 has the advantage of dissipating heat through its two faces (11.1, 11.2), an airflow favoring heat dissipation through heat transfer being generated on both faces (11.1, 11.2) of the heat sink (11) being generated, whereas the fin heat sink (8) as shown in FIG. 10 concentrates heat dissipation on the only surface provided for that purpose, i.e., the surface of the fins, generating an airflow that is limited by the dissipating surface thereof as a result.

The applicant has experimentally found that due to its laminar configuration devoid of fins, the heat sink (11) of the invention has better heat dissipation conditions compared to the fin heat sink (8) of the prior state of the art. The comparison is shown in FIG. 12 and was performed under the same test conditions using the same LED PCB (5) as a heat source and one and the same enclosure.

Figure 12:
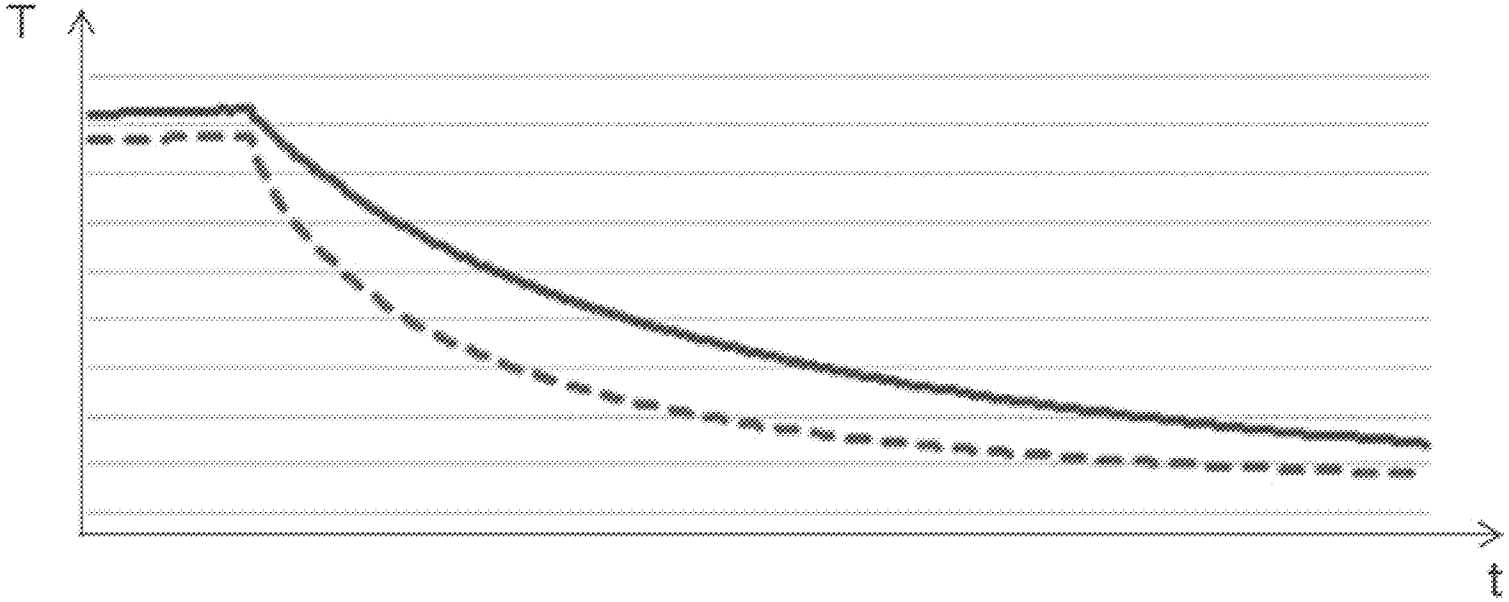
FIG. 12 shows a graph comparing the cooling curves of the fin heat sink of the prior state of the art and the heat sink having a laminar configuration of the invention.

FIG. 12 shows a graph comparing the cooling curves of the fin heat sink (8) of the prior state of the art and the heat sink (11) of the invention. The cooling curve shown by means of a solid line corresponds with the fin heat sink (8), whereas the cooling curve shown by means of a dashed line corresponds with the heat sink having a laminar configuration of the invention (11). In said graph, it is observed that the cooling curve corresponding to the heat sink of the invention (11) shows a temperature reduction in a shorter time compared with the cooling curve of the fin heat sink (8).

One of the features of the fin heat sink (8) which negatively affects heat dissipation efficiency is that the heat given off by each of the corresponding faces thereof is concentrated in the volume of air between the fins, so said fins give off heat to one another. This problem is solved by the heat sink having a laminar configuration of the invention (11).

The invention claimed is:

1. An apparatus comprising:

a frame having a first side and a second side;

a cover coupled to the first side of the frame;

a light diffuser element coupled to the second side of the frame;

a heat-conducting laminar body coupled to the frame, the heat-conducting laminar body having first and second faces on opposite sides of the body and a perimetral surface;

at least one printed circuit board disposed on the first face of the heat-conducting laminar body, the at least one printed circuit board comprising one or more light emitting diodes; and a power supply equipment disposed on the second face of the heat-conducting laminar body, wherein the each of the first and second faces of the heat-conducting laminar body has a flat surface.

2. The apparatus according to claim 1, wherein the first face of the heat-conducting laminar body is completely covered by the light diffuser element such that no portion of the first face is exposed to outside air.

3. The apparatus according to claim 1, wherein the first face of the heat-conducting laminar body is partially covered by the light diffuser element, such that a portion of the first face is exposed to outside air.

4. The apparatus according to claim 1, wherein the at least one printed circuit board is integrated in the heat-conducting laminar body, thereby forming a single body.

5. The apparatus according to claim 1, wherein the heat-conducting laminar body has a rectangular cross-section, wherein the first and second faces of the heat-conducting laminar body are flat over their respective surfaces.

6. The apparatus according to claim 1, wherein the heat-conducting laminar body has an anodizing treatment.

7. The apparatus according to claim 1, wherein the at least one printed circuit board has at least one light-emitting diode with a power greater than 1 W.

8. The apparatus according to claim 1, wherein a layer of thermally insulating material is arranged on one of the first and second faces of the heat-conducting laminar body.

9. The apparatus according to claim 1, wherein the second face of the heat-conducting laminar body comprises an electronic assembly housed in a leak-tight compartment.

10. The apparatus according to claim 2, wherein the first face of the heat-conducting laminar body comprises a light assembly housed in a leak-tight compartment formed by the heat-conducting laminar body and the light diffuser element.

11. The apparatus according to claim 1, wherein the heat-conducting laminar body has one of a through hole and a groove arranged on the perimetral surface, adapted to receive a finger or a tool to facilitate handling thereof.

* * * * *